US009175653B2

(12) United States Patent
Woo et al.

(10) Patent No.: US 9,175,653 B2
(45) Date of Patent: Nov. 3, 2015

(54) COMBUSTION GENERATING DEVICE OF INTERNAL COMBUSTION ENGINE

(75) Inventors: Soohyung Woo, Yongin-si (KR); Jinkook Kong, Suwon-si (KR); Youngnam Kim, Hwaseong-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 574 days.

(21) Appl. No.: 13/549,180

(22) Filed: Jul. 13, 2012

(65) Prior Publication Data

US 2013/0146027 A1 Jun. 13, 2013

(30) Foreign Application Priority Data

Dec. 13, 2011 (KR) ..... 10-2011-0133767

(51) Int. Cl.

*F02M 57/06* (2006.01)
*F02M 69/04* (2006.01)
*F02B 19/12* (2006.01)

(52) U.S. Cl.

CPC ..... *F02M 57/06* (2013.01); *F02M 69/045* (2013.01); *F02B 19/12* (2013.01)

(58) Field of Classification Search

CPC .. F02B 17/005; F02B 2275/14; F02B 23/105; F02B 1/04; F02B 2075/125; F02B 23/104; F02B 75/22; F02B 1/12; F02M 69/045; F02M 21/0275; F02M 57/06; F02M 61/162; F02M 31/135; F02M 31/045; F02M 31/04; F02M 59/366; F02M 61/042; F02M 57/00; F02M 69/08; F02M 67/02; F02M 67/12; F02M 1/00; F02M 63/0225; F02M 57/025; F02D 2041/3088; F02D 19/023; F02D 7/02; F02F 1/242; F01L 7/022; F01L 13/08; F23Q 7/001; F02P 7/0632; B60R 25/04

See application file for complete search history.

(56) References Cited

U.S. PATENT DOCUMENTS

| | | | | | |
|---|---|---|---|---|---|
| 4,280,661 | A * | 7/1981 | Tanasawa et al. | ..... | 239/409 |
| 5,218,943 | A * | 6/1993 | Takeda et al. | ..... | 123/531 |
| 5,983,865 | A * | 11/1999 | Yamashita et al. | ..... | 123/472 |
| 6,755,175 | B1 * | 6/2004 | McKay et al. | ..... | 123/297 |
| 2004/0065293 | A1 * | 4/2004 | Goto | ..... | 123/275 |
| 2006/0169244 | A1 * | 8/2006 | Allen | ..... | 123/297 |
| 2007/0028900 | A1 * | 2/2007 | Allen | ..... | 123/531 |
| 2008/0035110 | A1 * | 2/2008 | Biemelt et al. | ..... | 123/431 |

FOREIGN PATENT DOCUMENTS

| | | | |
|---|---|---|---|
| JP | 2004-3458 | A | 1/2004 |
| JP | 2004-211633 | A | 7/2004 |
| JP | 2007-64101 | A | 3/2007 |
| JP | 2009-221936 | A | 10/2009 |
| KR | 1998-048164 | A | 9/1998 |
| KR | 2002-0054332 | A | 7/2002 |

* cited by examiner

*Primary Examiner* — Lindsay Low
*Assistant Examiner* — Brian P Monahon
(74) *Attorney, Agent, or Firm* — Morgan, Lewis & Bockius LLP

(57) ABSTRACT

Provided is a combustion generating device of an internal combustion engine, which is capable of performing very precise flame control through a simple structure which does not need a prechamber and reducing harmful exhaust gas through low-temperature rapid combustion. The combustion generating device includes: an ignition system generating a spark; and an injector generating a mixture by mixing air and fuel and injecting a flame into a combustion chamber, the flame being generated by applying the spark to the mixture.

5 Claims, 8 Drawing Sheets

WAIT FOR INJECTION

WAIT FOR INJECTION

INJECT MIXTURE AT THE SAME TIME AS IGNITION

WAIT FOR INJECTION

INJECT MIXTURE AT THE SAME TIME AS IGNITION

COMBUSTION GENERATING DEVICE OF INTERNAL COMBUSTION ENGINE

CROSS-REFERENCE TO RELATED APPLICATIONS

The present application claims priority to Korean Patent Application Number 10-2011-0133767 filed Dec. 13, 2011, the entire contents of which application is incorporated herein for all purposes by this reference.

BACKGROUND OF THE INVENTION

1. Field of the Invention

The present invention relates to a combustion generating device of an internal combustion engine, and more particularly, to a combustion generating device of an internal combustion engine, which directly injects a flame into a combustion chamber, the flame being ignited and generated at the same time as a mixture of air and fuel is injected from a sub injector which mixes the air and fuel and injects the mixture.

2. Description of Related Art

In general, an internal combustion engine using gasoline as fuel, such as an engine of a vehicle, directly injects fuel into a combustion chamber formed in a cylinder block through an injector, and the fuel injected into the combustion chamber is burned by a flame generated through an ignition system, for example, a spark plug.

In the internal combustion engine having the above-described structure, the size of a flame kernel formed by a spark of the spark plug is small, and the duration thereof is short. Therefore, the fuel mixture within the combustion chamber may not be completely burned. During lean burn (ultra lean) combustion for improving fuel efficiency, a large amount of nitrogen oxide is generated by high-temperature combustion. Therefore, the internal combustion engine requires an expensive catalytic filter to reduce the nitrogen oxide.

In order to overcome such a defect, a prechamber jet ignition system is used. The prechamber jet ignition system enables low-temperature rapid combustion during ultra lean combustion of fuel within the combustion chamber, thereby reducing the amount of nitrogen oxide. Further, the prechamber jet ignition system may continuously and stably generate a very large flame kernel. The prechamber jet ignition system includes a prechamber formed above the combustion chamber and communicating with the combustion chamber, a sub injector installed to inject fuel to the prechamber, and a spark plug for igniting fuel within the prechamber.

Accordingly, after a mixture is introduced into the combustion chamber or fuel is injected through an injector, a small amount of fuel is injected into the prechamber through the sub injector, and the spark plug generates a spark inside the prechamber so as to ignite the fuel within the prechamber. The flame ignited in such a manner is injected to a fuel chamber from the prechamber, and the fuel within the combustion chamber is burned by the flame injected from the prechamber.

However, in the above-described internal combustion engine where combustion is performed in the combustion chamber through the flame injected from the prechamber, an accidental fire is highly likely to occur when an ultra small amount of fuel is injected into a small space formed by the prechamber and ignited by the spark plug. In this case, the engine may be failed. Further, since the air within the prechamber is not fresh external air but exhaust gas remaining in a previous explosion stroke, the prechamber contains a small amount of oxygen. Accordingly, the combustion inside the prechamber is destabilized. In addition, the internal combustion engine has difficulties in performing precise ignition control such as air-fuel ratio control or combustion speed control.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a combustion generating device of an internal combustion engine, which is capable of performing very precise flame control through a simple structure which does not need a prechamber and reducing harmful exhaust gas through low-temperature rapid combustion.

In an aspect of the present invention, a combustion generating device of an internal combustion engine, may include an ignition unit generating a spark, and an injector generating a mixture of air and fuel by mixing the air and the fuel supplied thereto and injecting a flame into a combustion chamber, the flame being generated by applying the spark to the mixture.

The ignition unit may include a spark plug installed inside or outside the injector.

The injector unit may include an injector body, a valve slidably mounted in the injector body, selectively receiving the fuel and the air according to a movement of the valve and mixing the received fuel and air to generate the mixture thereof, and injecting the generated mixture into the combustion chamber, and a solenoid unit receiving a control signal from an engine control unit (ECU) and selectively moving the valve in the injector body in a longitudinal direction of the valve.

The injector body is mounted in an upper portion of the combustion chamber and fluid-communicating with the combustion chamber, and the solenoid unit is installed inside an upper portion of the injector body.

The injector unit may further include a valve groove formed in the center of the injector body in the longitudinal direction of the injector body, wherein the valve is installed in the valve groove so as to move along a longitudinal direction of the valve groove, an injection hole formed under a lower portion of the valve in the injection body and fluid-communicating with a lower end of the valve groove, wherein the injection hole may have an expanded diameter along the longitudinal direction of the injector body, an air supply port and a fuel supply port formed to the injector body for supplying the fuel and the air to the inside of the valve, supply holes formed to the valve to fluid-communicate with the air supply port and the fuel supply port, respectively, or to be blocked so as not to communicate with the air supply port and the fuel supply port, respectively according to the movement of the valve, a mixing hole to which the supply holes are fluid-connected, wherein the mixing hole extends in the valve along the longitudinal direction of the valve, and a discharge hole formed to the valve and fluid-connected with the mixing hole, wherein the discharge hole extends outward in a radial direction of the valve, wherein a spark plug is installed in the injection hole so as to protrude inwards in a radial direction of the valve body.

A nozzle is formed under the injection hole.

The injector unit may further include an air supply port and a fuel supply port formed to the injection body for supplying the air and the fuel to the inside of the valve, a valve groove formed in the center of the injector body in a longitudinal direction of the injector body, wherein the valve is installed in the valve groove so as to move along the longitudinal direction of the valve, a fuel supply member mounted inside the valve and fixed to the injector body, and a fuel supply hole formed inside the fuel supply member, wherein the fuel supply hole extends to a lower portion of the fuel supply member along the longitudinal direction thereof and continuously fluid-communicating with the fuel supply port of the injector body, wherein the fuel supply hole is fluid-connected with a fuel discharge hole formed to the fuel supply member and extending outward in the radial direction thereof, wherein the valve may have a valve discharge hole which is selectively fluid-connected to the fuel discharge hole, wherein the lower portion of the valve groove forms a mixing chamber between an outer circumference of the valve and an inner circumference of the injector body, and wherein a lower portion of the mixing chamber may have a shape that is opened or closed by a plug.

The plug is provided in a lower portion of the valve and gradually expanded outward a radial direction thereof.

According to the combustion generating device of the internal combustion engine of the present invention, the sub injector mixes fuel and air to inject a mixture. Therefore, as the combustion generating device does not need a prechamber, not only the construction of the combustion generating device may be simplified, but also a cylinder forming the internal combustion engine may be easily manufactured. Further, as the mixture is ignited by the spark plug in a state where the fuel and air are mixed in the sub injector, flame control may be performed with precision, which makes it possible to improve the power of the engine. In addition, low-temperature rapid combustion may be performed by flame propagation against the flame ignition of the spark plug, which makes it possible to reduce harmful exhaust gas. Moreover, the stability of the combustion may be improved to prevent a fail of the internal combustion engine and enhance fuel efficiency.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

Figure 1:
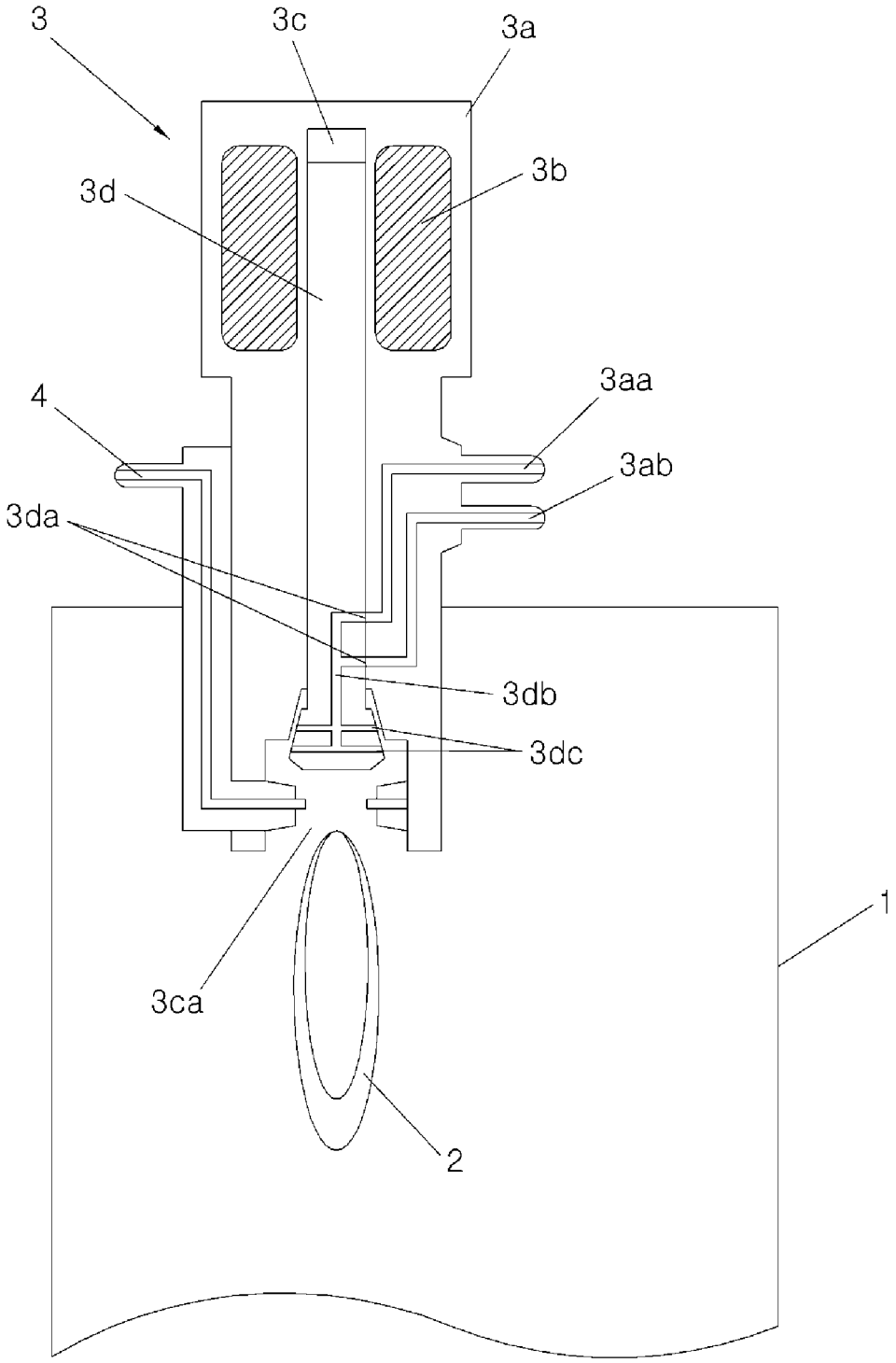
FIG. 1 is a cross-sectional view of a combustion generating device according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Hereinafter, the exemplary embodiments of the present invention will be described in detail with reference to the accompanying drawings.

Referring to FIG. 1, a combustion chamber 1 having a predetermined volume is formed in a cylinder forming an internal combustion engine. Although not illustrated, a fuel injection device such as an injector is installed to inject fuel into the combustion chamber.

A sub injector 3 is installed in the upper portion of combustion chamber 1 and injects a flame 2 into combustion chamber 1 so as to burn the fuel of the combustion chamber.

An opened lower end portion of sub injector 3 communicates with combustion chamber 1 such that the fuel of combustion chamber 1 is ignited by flame 2 injected through the lower end portion of sub injector 3.

Sub injector 3 includes an injector body 3*a* formed in a cylindrical shape and mounted in the upper portion of combustion chamber 1.

Injector body 3*a* includes a solenoid 3*b* buried and installed in the upper portion thereof. The operation of solenoid 3*b* is controlled by a control signal received from an engine control unit (ECU).

Sub injector 3 has a valve groove 3*c* formed in the center thereof and extended from the upper part to the lower part thereof along the longitudinal direction of injector body 3*a*.

A lower end of valve groove 3*c* communicates with an injection hole 3*ca* formed through a lower end surface of injector body 3*a* and having an expanded diameter.

A valve 3*d* is inserted into valve groove 3*c* and installed so as to be vertically moved by solenoid 3*b*.

A compressed air supply port 3*aa* for supplying compressed air into injector body 3*a* and a fuel supply port 3*ab* for supplying fuel are formed at a side surface of injector body 3*a*, and the compressed air and fuel are supplied into injector body 3*a* through ports 3*aa* and 3*ab*, respectively.

Valve 3*d* has two supply holes 3*da* formed at a predetermined distance from each other in a vertical direction, and supply holes 3*da* are connected to communicate with compressed air supply port 3*aa* and fuel supply port 3*ab*, respectively, or blocked so as not to communicate with compressed air supply port 3*aa* and fuel supply port 3*ab*, respectively. Two supply holes 3*da* are connected to communicate with a mixing hole 3*db* extended from a predetermined portion to the lower portion along the longitudinal direction of valve 3*d*, and mixing hole 3*db* is formed to communicate with two discharge holes 3*dc* expanded outward in the radial direction of valve 3*d*.

The number of discharge holes 3*dc* is not necessarily set to two. Specifically, as long as the mixture of fuel and air may be properly injected, the number of discharge holes 3*dc* may be set to one or three or more.

The supply holes and the mixing hole serve as a mixer which receives fuel and air through separate lines and mixes the fuel and air to generate a mixture.

A spark plug 4 serving as an ignition system is installed in injection hole 3*ca* so as to protrude inward in the radial direction. Spark plug 4 may be installed outside.

Accordingly, when fuel and air are supplied to injector body 3*a* through two supply ports 3*aa* and 3*ab*, respectively, the fuel and air are mixed with each other in mixing hole 3*db* communicating with two supply holes 3*da* of valve 3*d*, and the mixture is discharged to the outside of the valve through discharge holes 3*dc*. When the mixture is discharged as described above, spark plug 4 causes a spark to ignite the discharged mixture, and flame 2 generated by the ignition of the mixture is injected into combustion chamber 1.

Figure 2:
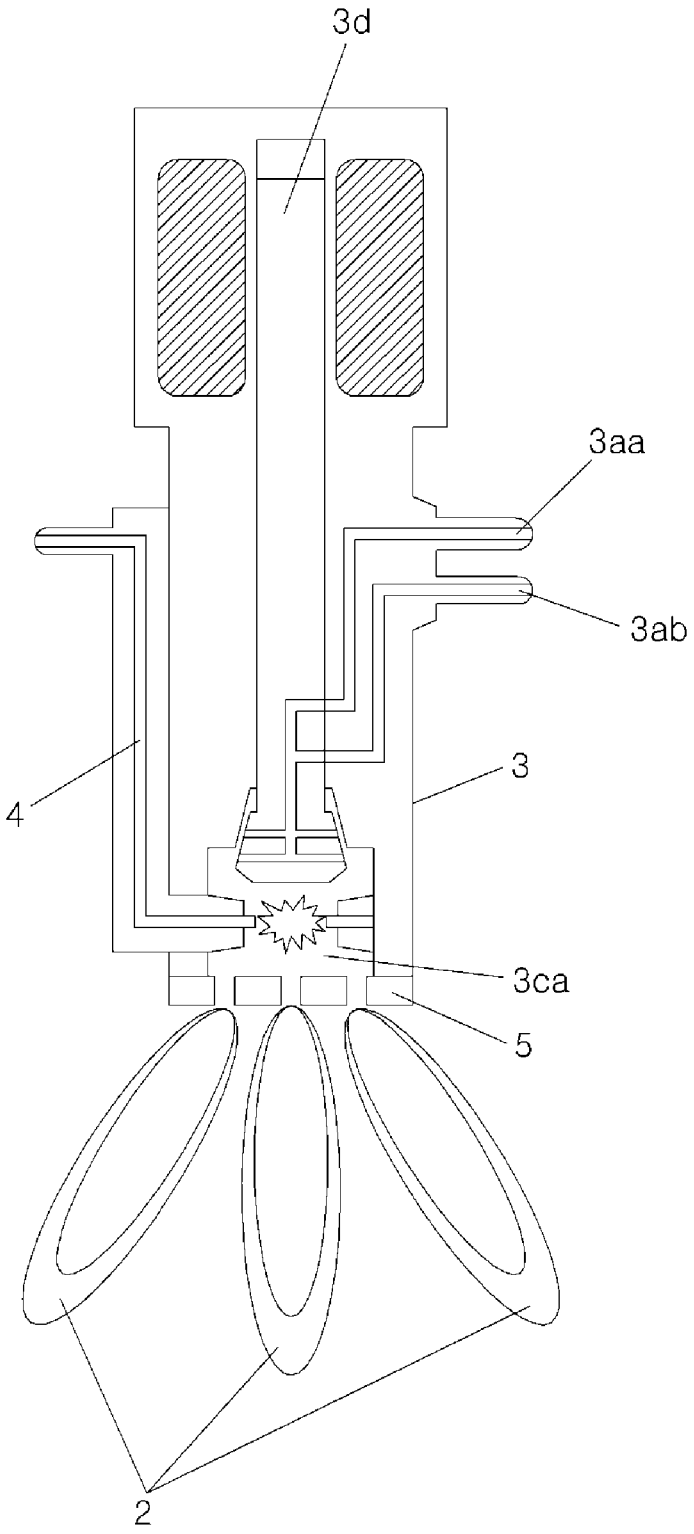
FIG. 2 is a cross-sectional view of a sub injector forming a combustion generating device according to another exemplary embodiment of the present invention.

Referring to FIG. 2, a nozzle 5 having a plurality of holes is additionally installed at a lower end of injection hole 3*ca*, and the other components have the same structure as illustrated in FIG. 1.

When nozzle 5 is installed as described above, the flame is divided into a plurality of parts through the holes of the nozzle and injected into combustion chamber 1.

Figure 3A:
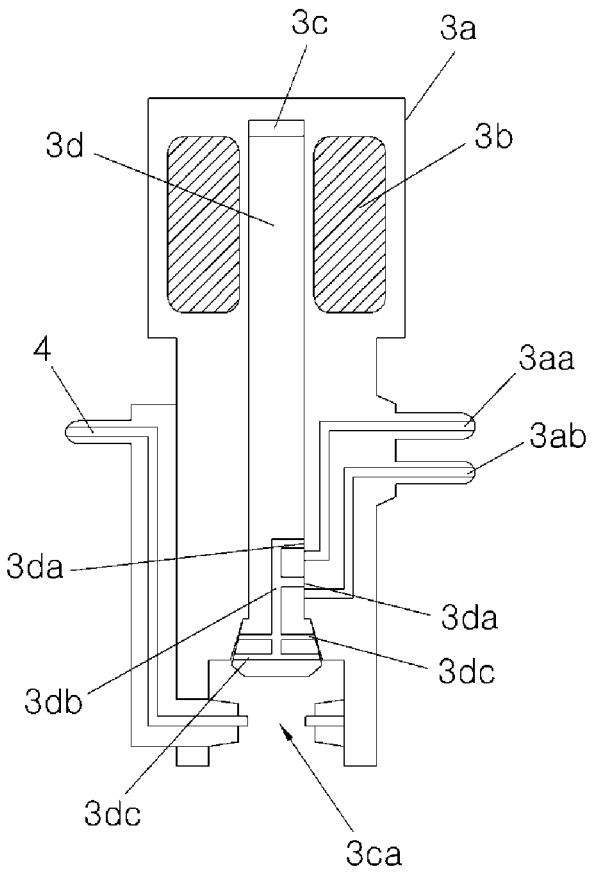
FIGS. 3A to 3C are cross-sectional views of a sub injector forming a combustion generating device according to the exemplary embodiment of the present invention, illustrating the operation procedure of the sub injector.

FIG. 3A illustrates that sub injector 3 according to the exemplary embodiment of the present invention is in a standby state. Referring to FIG. 3A, two supply holes 3*da* of valve 3*d* and two supply ports 3*aa* and 3*ab* of injector body 3*a* are arranged to deviate from each other such that the fuel and air supplied up to supply ports 3*aa* and 3*ab* of injector body 3*a* are not supplied to valve 3*d*.

Figure 3B:
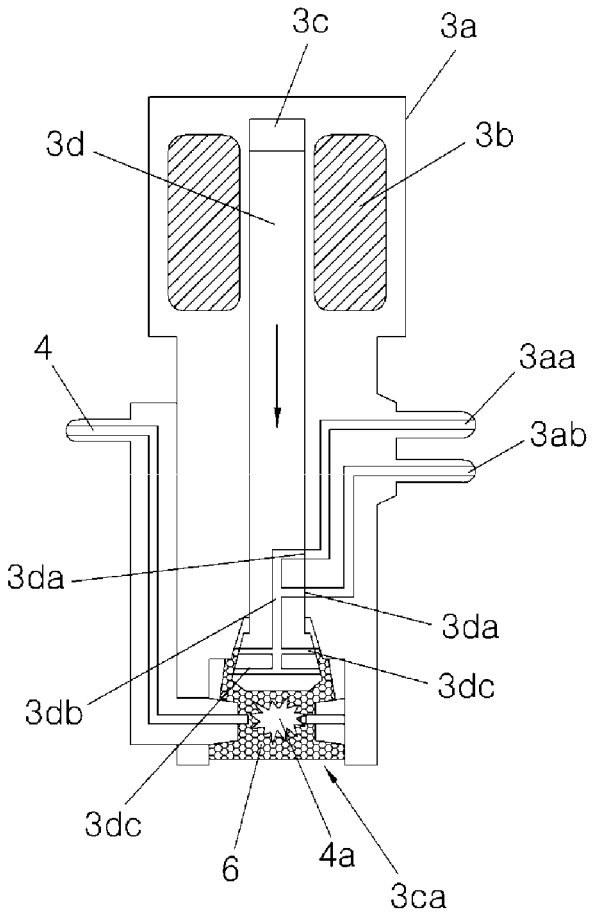

FIG. 3B illustrates that as a control signal of the ECU is applied to solenoid 3*b*, and valve 3*d* is moved downward by the operation of solenoid 3*b* such that two supply holes 3*da* of valve 3*d* and supply pots 3*aa* and 3*ab* are connected to communicate with each other.

Accordingly, the fuel and air supplied up to supply ports 3*aa* and 3*ab* of injector body 3*a* are supplied to two supply holes 3*da* of valve 3*d*, and then mixed with each other in mixing hole 3*db* to generate a mixture. Mixture 6 generated in such a manner is discharged to the outside of valve 3*d* through discharge hole 3*dc*, and then introduced into injection hole 3*ca*. Simultaneously, spark plug 4 generates a spark 4*a* to ignite mixture 6.

Figure 3C:
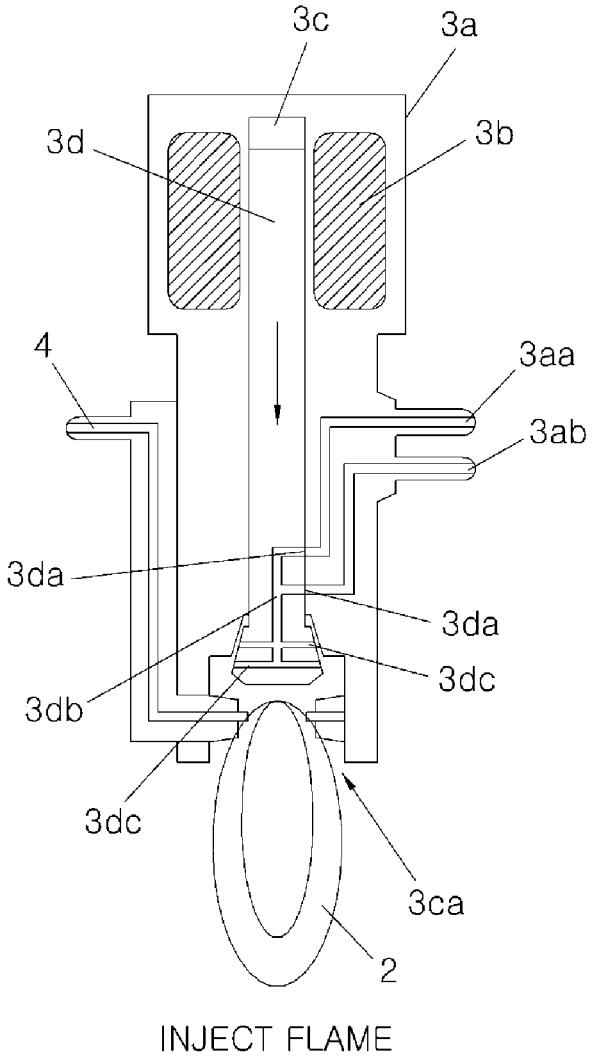

FIG. 3C illustrates that flame 2 generated by mixture 6 is injected into the combustion chamber.

Figure 4A:
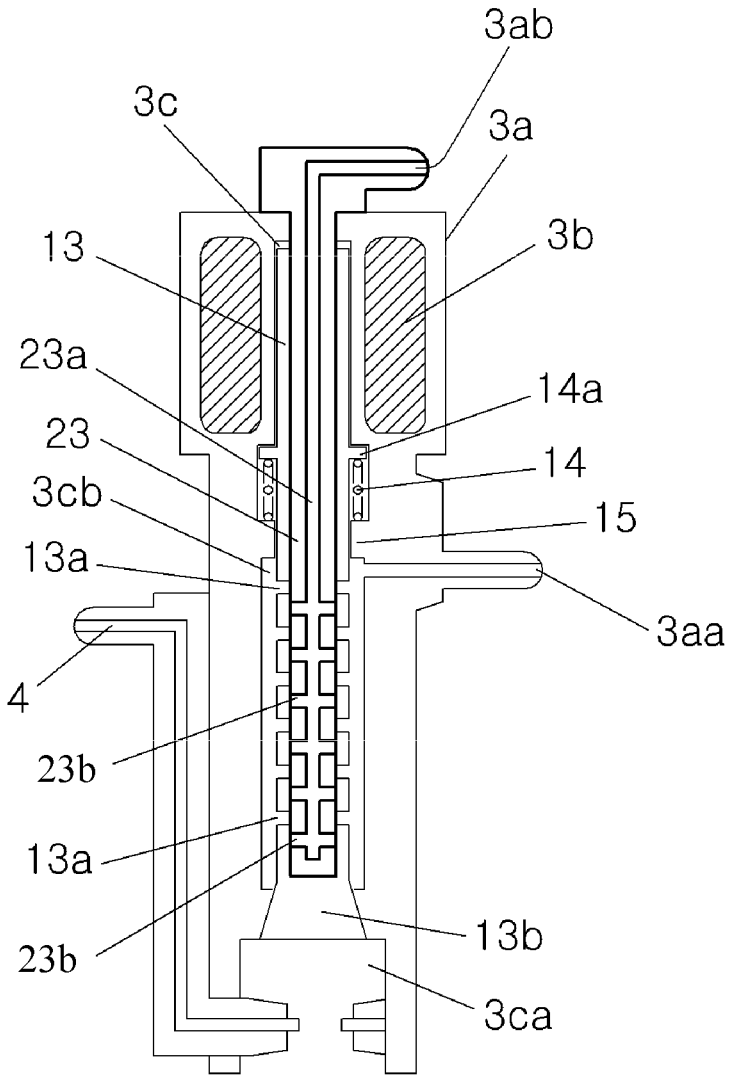
FIGS. 4A to 4C are cross-sectional views of a sub injector forming a combustion generating device according to another exemplary embodiment of the present invention, illustrating the operation procedure of the sub injector.
Figure 4B:
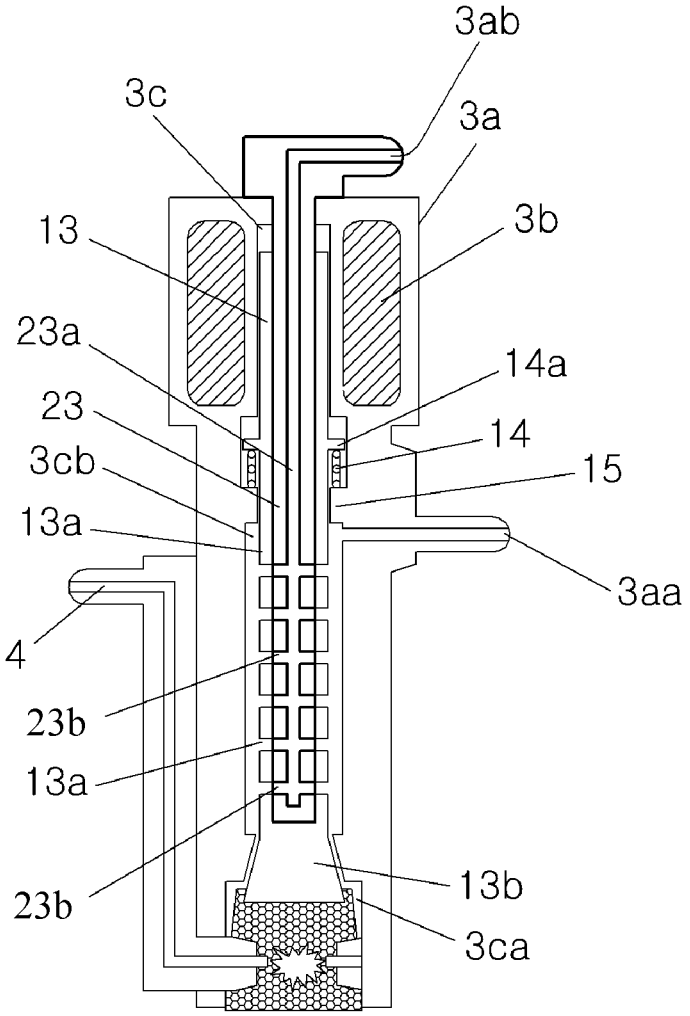
Figure 4C:
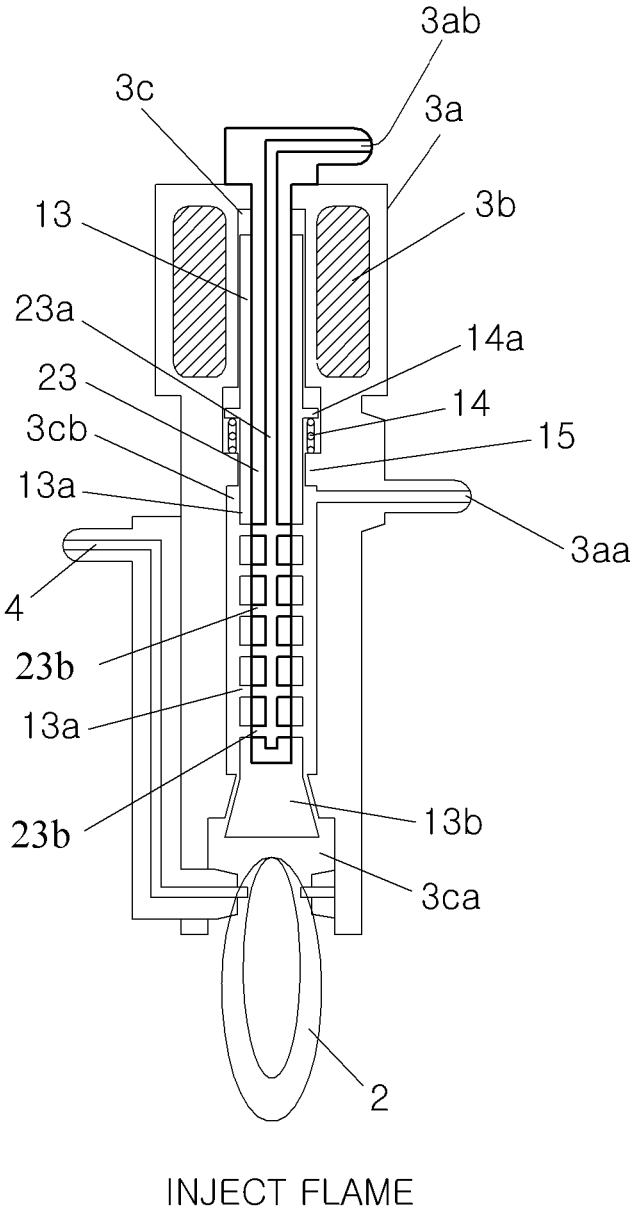

FIGS. 4A to 4C are cross-sectional views of a sub injector forming a combustion generating device according to another exemplary embodiment of the present invention, illustrating the operation procedure of the sub injector. The sub injector of FIGS. 4A to 4C is constructed in a different manner from the sub injector of FIGS. 2 and 3 in that a fuel supply member 23 is inserted into and fixed to the injection body 3*a*, valve 13 may be vertically moved in a state where the valve 13 moves along an outer surface of the fuel supply member 23, valve 13 is installed so as to move with respect to the fuel supply member 23, and valve 13 has a plug 13*b* formed in the lower portion thereof and having a shape that is gradually expanded outward in the radial direction.

Fuel supply member 23 includes a fuel supply hole 23*a* which always communicates with fuel supply port 3*ab* of injector body 3*a*, and fuel supply hole 23*a* is formed so to be extended to the lower portion along the longitudinal direction of fuel supply member 23 and has a plurality of fuel discharge holes 23*b* expanded outward in the radial direction.

Valve 13 has a plurality of valve discharge holes 13*a* which are selectively connected to fuel discharge holes 23*b*.

The lower portion of valve groove 3*c* is expanded in the radial direction so as to form a mixing chamber 3*cb* between the outer circumference of valve 13 and the internal circumference of injector body 3*a*. The lower portion of mixing chamber 23*cb* has a shape that is opened and closed by plug 13*b*.

FIG. 4A illustrates a state in which valve 13 is positioned upward by an elastic member 14 disposed inside the injection body 3*a* and supported by a protrusion 15 because a control signal was not applied to solenoid 3*b*. Accordingly, the inside of fuel supply member 23 is filled with fuel supplied to injector body 3*a* through the fuel supply port 3*ab*, and the inside of mixing chamber 3*cb* is filled with air supplied through an air supply port 3*aa*. The lower portion of mixing chamber 3*cb* is blocked by plug 13*b*.

FIG. 4B illustrates a state in which as a control signal of the ECU is applied to solenoid 3*b*, valve 13 is moved downward by the operation of solenoid 3*b*. Accordingly, a plurality of valve discharge holes 13*a* of valve 13 and a plurality of fuel discharge holes 23*b* of fuel supply member 23 communicate with each other to introduce the fuel to mixing chamber 3*cb* through fuel discharge holes 23*b*, and the fuel is mixed with the air to form a mixture.

The mixture is passed to an injection hole 3*ca* through the lower portion opened by the downward movement of valve 13. Simultaneously, spark plug 4 generates a spark 4*a* to ignite mixture 6.

FIG. 4C illustrates that a flame 2 generated by mixture 6 is injected into the combustion chamber.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A combustion generating device of an internal combustion engine, comprising:

an ignition unit generating a spark; and an injector unit comprising an injector generating a mixture of air and fuel by mixing the air and the fuel supplied thereto and injecting a flame into a combustion chamber, the flame being generated by applying the spark to the mixture, wherein the injector unit includes:

a spark plug installed inside the injector;

an injector body;

a valve slidably mounted in the injector body, selectively receiving the fuel and the air according to a movement of the valve and mixing the received fuel and air to generate the mixture thereof, and injecting the generated mixture into the combustion chamber;

a solenoid unit receiving a control signal from an engine control unit (ECU) and selectively moving the valve in the injector body in a longitudinal direction of the valve;

an air supply port and a fuel supply port formed to the injection body for supplying the air and the fuel to the inside of the valve;

a valve groove formed in the center of the injector body in a longitudinal direction of the injector body, wherein the valve is installed in the valve groove so as to move along the longitudinal direction of the valve;

a fuel supply member mounted inside the valve and fixed to the injector body, wherein the valve is slidably mounted on an outer surface of the fuel supply member; and a fuel supply hole formed inside the fuel supply member, wherein the fuel supply hole extends to a lower portion of the fuel supply member along the longitudinal direction thereof and continuously fluid-communicating with the fuel supply port of the injector body, the fuel supply hole is fluid-connected with a plurality of fuel discharge holes formed along the longitudinal direction of the fuel supply hole, and each of the fuel discharge holes extends outward radially from the fuel supply hole, the valve has a plurality of valve discharge holes which is selectively fluid-connected to the plurality of the fuel discharge holes, the lower portion of the valve groove forms a mixing chamber between an outer circumference of the valve and an inner circumference of the injector body, and a lower portion of the mixing chamber has a shape that is opened or closed by a plug.

2. The combustion generating device as defined in claim 1, wherein the injector body is mounted in an upper portion of the combustion chamber and fluid-communicating with the combustion chamber, and the solenoid unit is installed inside an upper portion of the injector body.

3. The combustion generating device as defined in claim 1, wherein the injector unit further includes:

a valve groove formed in the center of the injector body in the longitudinal direction of the injector body, wherein the valve is installed in the valve groove so as to move along a longitudinal direction of the valve groove;

an injection hole formed under a lower portion of the valve in the injection body and fluid-communicating with a lower end of the valve groove, wherein the injection hole has a diameter that increases along the longitudinal direction of the injector body, an air supply port and a fuel supply port formed to the injector body for supplying the fuel and the air to the inside of the valve;

supply holes formed to the valve to fluid-communicate with the air supply port and the fuel supply port, respectively, or to be blocked so as not to communicate with the air supply port and the fuel supply port, respectively according to the movement of the valve;

a mixing hole to which the supply holes are fluid-connected, wherein the mixing hole extends in the valve along the longitudinal direction of the valve; and a discharge hole formed to the valve and fluid-connected with the mixing hole, wherein the discharge hole extends outward in a radial direction of the valve, wherein a spark plug is installed in the injection hole so as to protrude inwards in a radial direction of the valve body.

4. The combustion generating device as defined in claim 3, wherein a nozzle is formed under the injection hole.

5. The combustion generating device as defined in claim 1, wherein the plug is provided in a lower portion of the valve and gradually expanded outward a radial direction thereof.

* * * * *